US006265466B1

(12) United States Patent
Glatkowski et al.

(10) Patent No.: US 6,265,466 B1
(45) Date of Patent: Jul. 24, 2001

(54) ELECTROMAGNETIC SHIELDING COMPOSITE COMPRISING NANOTUBES

(75) Inventors: Paul Glatkowski, Littleton; Patrick Mack, Milford, both of MA (US); Jeffrey L. Conroy, Rumford, RI (US); Joseph W. Piche, Raynham; Paul Winsor, Somerset, both of MA (US)

(73) Assignee: Eikos, Inc., Franklin, MA (US)

( * ) Notice: Subject to any disclaimer, the term of this patent is extended or adjusted under 35 U.S.C. 154(b) by 0 days.

(21) Appl. No.: 09/250,047

(22) Filed: Feb. 12, 1999

(51) Int. Cl.[7] ..... G21F 1/10
(52) U.S. Cl. ..... 523/137
(58) Field of Search ..... 523/137; 428/376, 428/377, 378, 461, 462, 460

(56) References Cited

U.S. PATENT DOCUMENTS 5,547,525 * 8/1996 Bennett et al. ..... 149/19.1
5,640,705 * 6/1997 Koruga ..... 588/16
5,853,877 * 12/1998 Shibuta ..... 478/357

* cited by examiner

*Primary Examiner*—Edward J. Cain
*Assistant Examiner*—Katarzyna Wyrozebski
(74) *Attorney, Agent, or Firm*—Brobeck, Phleger & Harrison LLP

(57) ABSTRACT

An electromagnetic shielding composite having nanotubes and a method of making the same are disclosed. According to one embodiment of the present invention, the composite for providing electromagnetic shielding includes a polymeric material and an effective amount of oriented nanotubes for EM shielding, the nanotubes being oriented when a shearing force is applied to the composite. According to another embodiment of the present invention, the method for making an electromagnetic shielding includes the steps of (1) providing a polymer with an amount of nanotubes, and (2) imparting a shearing force to the polymer and nanotubes to orient the nanotubes.

27 Claims, 1 Drawing Sheet

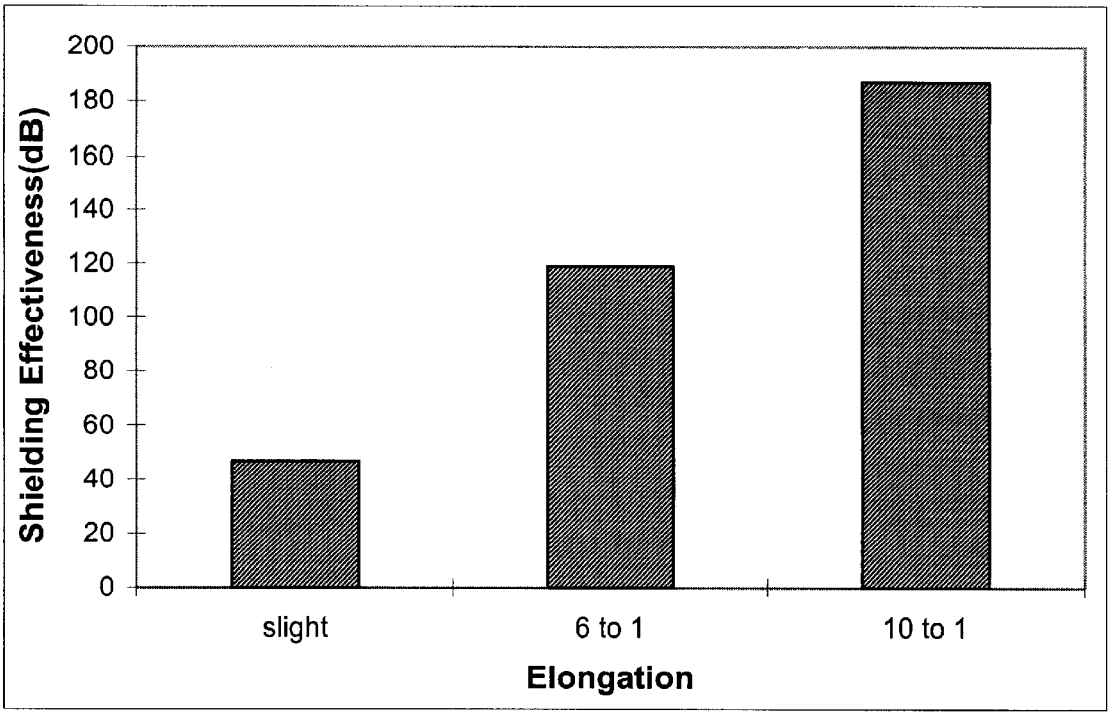
FIG. 1. EM Shielding Effectiveness as a function of shear load of 1.5% nanotube containing PET.

ELECTROMAGNETIC SHIELDING COMPOSITE COMPRISING NANOTUBES

FIELD OF THE INVENTION

The present invention relates generally to electromagnetic (EM) radiation absorbing composites containing nanotubes.

The need for electromagnetic shielding materials is enormous. Applications of EM shielding material are found in, for example, EM-sensitive electronic equipment, stealth vehicles, aircraft, etc., having low radar profiles, protection of electronic components from interference from one another on circuit boards, protection of computer equipment from emitting RF radiation causing interference to navigation systems, medical life support systems, etc. Metal shielding has long been known for these functions. However, with the replacement of metals by a wide variety of new materials, e.g. polymeric, there has been a loss of the metals' inherent EM shielding characteristics. Some attempts at improving the EM shielding characteristics of plastics have been made. However, these approaches suffer from substantial drawbacks. Thus, new and improved methods and materials are needed to effect the desired shielding.

SUMMARY OF THE INVENTION

This invention represents a new approach to electromagnetic shielding. It is not derived from conventional concepts related to conductivity-based approaches. It has been discovered that conductivity is not required for the composite of this invention to provide very effective EM shielding. The latter term has its conventional meaning herein. In fact, composites having essentially no or low bulk conductivity, i.e., conventionally being classifiable as insulators, have excellent EM shielding properties. Without being bound by theory, it is believed that in composites of this invention which have such low bulk conductivity, EM shielding is achieved through absorption of radiation rather than reflection. By "low bulk conductivity" in this context is meant general macroscopic low conductivity, but it also includes anisotropically low conductivity in at least one dimension, e.g., in a sheet-type composite, low conductivity across the plane (thickness) of the sheet and not necessarily across the length or width of the sheet. Thus, both isotropic and anisotropic low or essentially no bulk conductivity (e.g., insulating properties) are included. Such low conductivities can be achieved for example by not including processing steps which would enhance isotropic or random electrical contact among the nanotubes.

In another preferred embodiment of this invention, the nanotubes do not substantially increase the bulk conductivity (as discussed above) of the polymer which forms the base of the composite. Thus, polymers which are conventionally classified as insulators remain insulators. In one embodiment the nanotubes are primarily not in isotropic contact with each other and for nanotubes which are in contact with each other, e.g., in general alignment along the nanotubes' longitudinal axes, they are not bonded or glued to each other (other than by virtue of being copresent in the base polymer formulation). For example, when the composites are subjected to a shearing treatment as described herein, the nanotubes become aligned and/or disentangled as a result of which the EM shielding properties of the composites are enhanced or optimized. Without wishing to be bound by theory, it is believed that such alignment or disentanglement increases the effective aspect ratio of the nanotubes collectively. For instance, in disentangling and/or alignment of the nanotubes, some of the nanotubes become in contact with each other more or less along the their longitudinal axes whereby they act effectively as a single nanotube having a length in such direction longer than that of either of two individual contacting nanotubes. Typically, the effective aspect ratios will be at least about 100:1, 500:1, 1000:1 etc. or greater.

In an especially preferred aspect of this invention, the composite will have both high EM shielding properties and also low radar profile due to the high absorptiveness of the composites and correspondingly low reflectance to electromagnetic radiation.

Thus, in one aspect, this invention relates to an electromagnetic (EM) shielding composite comprising a polymer and an amount of nanotubes effective for EM shielding, e.g., of RF and microwave and radiation of higher frequencies.

In a further aspect, this invention relates to an electromagnetic (EM) shielding composite comprising a polymer and an amount of substantially aligned nanotubes effective for EM shielding.

In a further aspect, this invention relates to an EM shielding composite comprising a polymer and an amount of nanotubes effective for EM shielding, wherein said composite has been subjected to shearing, stretching and/or elongation, which aligns and/or disentangles nanotubes contained therein.

In a further aspect, this invention relates to a method for preparing an EM shielding composite comprising a polymer and an amount of nanotubes effective for electromagnetic shielding comprising formulating said polymer and nanotubes and shearing, stretching, or elongating the composite.

In a further aspect, this invention relates to an electromagnetic shielding composite, e.g., energy absorbing composite, comprising a non-carbonizable polymer and nanotubes in an amount effective for EM shielding, e.g., energy absorption. This invention does not require carbonization to induce EM shielding properties.

In a further aspect, this invention relates to an EM shielding composite comprising an inner space and a surface defining said space, the improvement wherein said surface comprises a layer of nanotubes according to the invention effective for EM shielding.

In a further aspect, this invention relates to a method of lowering the radar observability of an object comprising partially or entirely surrounding said object with a layer of nanotubes according to the invention effective for lessening radar observability.

In a further aspect, this invention relates to a method of electromagnetic (EM) shielding an object or space comprising partially or entirely surrounding said object or space with a layer of composite of this invention.

In a further aspect, this invention relates to an electromagnetic shielding composite, comprising nanotubes mixed in a polymer, wherein the composite is absorptive and effective for shielding broadband electromagnetic radiation, e.g., in a range of $10^3$ Hz to $10^{17}$ Hz.

In a further aspect, this invention relates to an electromagnetic radiation absorbing composite, comprising nanotubes mixed in a polymer, wherein the composite is absorptive, e.g., to RF and microwave radiation and higher frequencies in dependence also on the properties of the base polymer, and, thus, effective for shielding from broadband electromagnetic radiation, e.g., in a range of $10^3$ Hz to $10^{17}$ Hz, and for generating heat.

The foregoing and other objects, features, and advantages of the invention will be apparent from the following more particular description of preferred embodiments as illustrated in the accompanying examples, in which reference characters refer to the same parts throughout the various views.

Primary components of the electromagnetic shielding composites of this invention are the base polymeric material and the nanotubes.

Suitable raw material nanotubes are known. The term "nanotube" has its conventional meaning as described; see R. Saito, G. Dresselhaus, M. S. Dresselhaus, "Physical Properties of Carbon Nanotubes," Imperial College Press, London U.K. 1998, or A. Zettl "Non-Carbon Nanotubes" *Advanced Materials*, 8, p. 443 (1996). Nanotubes useful in this invention, include, e.g., straight and bent multi-wall nanotubes, straight and bent single wall nanotubes, and various compositions of these nanotube forms and common by-products contained in nanotube preparations. Nanotubes of different aspect ratios, i.e. length-to-diameter ratios, will also be useful in this invention, as well as nanotubes of various chemical compositions, including but not limited to carbon, boron nitride, SiC, and other materials capable of forming nanotubes. Typical but non-limiting lengths are about 1–10 nm, for example.

Methods of making nanotubes of different compositions are known. (See "Large Scale Purification of Single Wall Carbon Nanotubes: Process, Product and Characterization," A. G. Rinzler, et. *al., Applied Physics A*, 67, p. 29 (1998); "Surface Diffusion Growth and Stability Mechanism of BN Nanotubes produced by Laser Beam Heating Under Super-high Pressures," O. A. Louchev, *Applied Physics Letters*, 71, p. 3522 (1997); "Boron Nitride Nanotube Growth Defects and Their Annealing-Out Under Electron Irradiation," D. Goldberg, et. *al, Chemical Physics Letters*, 279, p. 191, (1997); Preparation of beta-SiC Nanorods with and Without Amorphous $SiO_2$ Wrapping Layers, G. W. Meng et. al., Journal of Materials Research, 13, p. 2533 (1998); U.S. Pat. Nos. 5,560,898, 5,695,734, 5,753,088, 5,773,834. Carbon nanotubes are also readily commercially available from CarboLex, Inc. (Lexington, Ky.) in various forms and purities, and from Dynamic Enterprises Limited (Berkshire, England) in various forms and purities, for example.

The particular polymeric material used in the composites of this invention is not critical. Typically, it will be chosen in accordance with the structural, strength, design, etc., parameters desirable for the given application. A wide range of polymeric resins, natural or synthetic, is useful. The polymeric resins are carbonizable or non-carbonizable, often non-carbonizable. These include thermoplastics, thermosets, and elastomers. Thus, suitable synthetic polymeric resins include, but are not limited to, polyethylene, polypropylene, polyvinyl chloride, styrenics, polyurethanes, polyimides, polycarbonate, polyethylene terephthalate, acrylics, phenolics, unsaturated polyesters, etc. Suitable natural polymers can be derived from a natural source, i.e., cellulose, gelatin, chitin, polypeptides, polysaccharides, or other polymeric materials of plant, animal, or microbial origin.

The polymeric materials can contain other conventional ingredients and additives well known in the field of polymers to provide various desirable properties. Typically, these other substances are contained in their conventional amounts, often less than about 5 weight percent. Similarly, the polymeric materials can be crystalline, partially crystalline, amorphous, cross-linked, etc., as may be conventional for the given application.

The amount of nanotubes in the material will typically be in the range of 0.001 to 15 weight percent based on the amount of polymer, preferably 0.01 to 5 weight percent, most preferably 0.1 to 1.5 weight percent. The nanotubes typically are dispersed essentially homogeneously throughout the bulk of the polymeric material but can also be present in gradient fashion, increasing or decreasing in amount (e.g. concentration) from the external surface toward the middle of the material or from one surface to another, etc. In addition, the nanotubes can be dispersed only in an external or internal region of the material, e.g., forming in essence an external skin or internal layer. In all cases, the amount of nanotubes will be chosen to be effective for the desired electromagnetic shielding and/or absorbing effect in accordance with the guidance provided in this specification. Aligned, oriented, disentangled, and/or arrayed nanotubes of appropriate effective aspect ratio in a proper amount mixed with a polymer can be synthesized to meet shielding requirements. At most a few routine parameteric variation tests may be required to optimize amounts for a desired purpose. Appropriate processing control for achieving a desired array of nanotubes with respect to the plastic material can be achieved using conventional mixing and processing methodology, including but not limited to, conventional extrusion, multi-dye extrusion, press lamination, etc. methods or other techniques applicable to incorporation of nanotubes into a polymer such as a thermoset resin, e.g., methods for preparing interlaminate adhesive and/or shielding layers.

One method to achieve the enhanced EM shielding effect of the nanotubes as used in accordance with this invention is to expose the composite to a shearing, stretching, or elongating step or the like, e.g., using conventional polymer processing methodology. Such shearing-type processing refers to the use of force to induce flow or shear into the composite, forcing a spacing, alignment, reorientation, disentangling etc. of the nanotubes from each other greater than that achieved for nanotubes simply formulated into admixture with polymeric material. It is believed without wishing to be bound by theory that the advantages provided by this invention may be due to enhanced alignment or orientation among the nanotubes as compared with the relatively random structure achieved without the shearing, stretching, or elongation-type step. Such disentanglement etc. can be achieved by extrusion techniques, application of pressure more or less parallel to a surface of the composite, or application and differential force to different surfaces thereof, e.g., by shearing treatment by pulling of an extruded plaque at a variable but controlled rate to control the amount of shear and elongation applied to the extruded plaque. FIG. 1 illustrates the shielding effectiveness of a composite having nanotubes in an amount of 1.5 weight percent as a function of shear loading imparted by elongation. Suitable conditions can be routinely determined to achieve the desired electromagnetic shielding effect in accordance with this invention by routine parametric experimentation using the guidance of this application.

The composite of the invention can be utilized in essentially any form in which the underlying polymeric material is suitable, e.g., including fibers, cylinders, plaques, films, sheets molding or extrusion compounds, and essentially any other form or shape, depending on the configuration and desirable properties of the base host resin system and the application. Thus, the EM shielding composite of the present invention can be incorporated as chopped or continuous fibers, woven material, non-woven material, clothing, material formed by electrospinning or melt spinning processes, paints, elastomeric materials, non-elastomeric materials, etc. As an example, an entangled mesh of carbon nanotubes can be compounded into a polymer matrix and the resulting composite can then be processed by conventional plastics processing techniques and in accordance with this invention.

This invention also includes composites which are prepared directly by processing designed using the guidance of this disclosure thereby to dispense with the shearing, elongation or stretching step, and which thus do not need further treatment to achieve the advantageous properties of this invention.

Typically, thicknesses of the composites of this invention which achieve satisfactory EM shielding effects can be lower than 1 mm. Depending on the EM environment anticipated for the application, the loading, shearing load, and structural form of the composite will ultimately determine the useful thickness of the composite. Much thicker EM shielding composites can also be made according to this invention, with the upper limit defined by the limitations of the base polymers and/or processing techniques used to manufacture thick composite parts. These thickness values refer to the regions of the polymeric material which contain nanotubes and, thus, are not necessarily the same as the average thickness of the material. It is also possible to have more than one region within a given composite which contains nanotubes, e.g., alternating with layers essentially free of nanotubes, all layers being of variable thicknesses or the same thickness.

The nanotube component of this invention may impact properties of the polymeric material as is well known for any filler. These properties include strength, elongation, temperature stability and other physical properties. However, given the relatively low loading requirements of nanotube needed to achieve effective EM shielding per this invention, these effects are expected to be minimal. A suitable balance between the shielding effect and desired ranges of one or more of these other properties can be conventionally determined, e.g. with routine parametric experimentation when necessary.

The immense flexibility of the composites of this invention make them suitable for a very wide array of applications. These include: EM shielding on any kind of equipment or enclosure having contents which are sensitive to EM radiation, especially high bursts, protection of electronics in enclosures, protection of electronic components from interference from one another on circuit boards, protection of computer systems housed within plastic cases from outside electromagnetic interferences, as well as protection of systems from emitted RF radiation from surrounding computers, such as airline navigation system from laptop computers, and automotive electronics. Typically, electronic machinery and enclosures containing life forms are especially helped by this invention.

Shielding per this invention can be achieved by incorporating the nanotubes directly in composite materials which are otherwise necessary structural components of the equipment, enclosure, vehicle, aircraft, device, etc. Alternatively, skins, surfaces, layers, or regions of composites of nanotube-containing composites of this invention can be utilized, e.g., such as outer or inner "skins." For instance, such composite regions of this invention can be utilized in personnel protection clothing.

A special advantage of this invention is that the amount of nanotube composite needed to achieve the given desired level of EM shielding is much less than for conventional materials. As noted above, amounts less than 1% by weight of nanotubes of a composite can be used, and even less, depending on the particular needs of the application. The composites also retain the other advantages of the underlying base resin such as weight reduction with increased strength.

In addition to its EM shielding characteristic, the present invention also provides a low observability characteristic, e.g., with respect to radar. Low electromagnetic observability exists since the primary shielding mode of the present invention is by absorption, not reflection as with metals and purposely conducting material. Typically, this invention provides transmitted radiation levels of, e.g., 0.001% or less and reflected levels of less than about 16%, the principal amount of the EM radiation being absorbed by the materials of the invention.

These absorbing properties lend themselves to applications including microwave susceptors for cooking or browning food in microwave ovens.

The advantages of the EM shielding composite of the present invention include: commercial off-the-shelf availability of carbon nanotubes, ease of synthesis of nanotubes (of carbon or otherwise) low observability due to the low reflective power of less than about 16%, and the available low density of the shielding composite, e.g., 1.2–1.4 g/cm$^3$. The low loading levels of nanotubes required by this invention are advantageous for both their economy, lack of degradation of the base polymer's structural properties, and compatibility with most conventional polymer processing techniques.

In the foregoing and in the following examples, unless otherwise indicated, all parts and percentages are by weight. All publications mentioned herein are incorporated by reference in their entireties.

BRIEF DESCRIPTION OF THE DRAWINGS

FIG. 1 is a bar chart illustration of the EM shielding properties of one particular composite of the invention versus shear loading.

EXAMPLES

Example 1

Electromagnetic Shielding Effectiveness (EMSE)

Five pounds of pelletized polyethylene terephthalate (PET) with fifteen weight percent Graphite Fibril™ nanotubes were produced by Hyperion Catalysis International. This Hyperion concentrate of 15 wt % carbon fibers in unspecified Eastman extrusion grade PET polyester resin was used as a master batch for let down (dilution) with neat Natural PET resin 0.85 IV Eastman natural PET. Both resins dried 4.5 hours at 290 F. and kept in sealed glass bottles before use. The 1.5% carbon resin was a 9:1 blend of the concentrate and the neat resin by weight. 2:1 blends of concentrate with natural were made to reduce carbon content from 15% to 10% and again from 10% to 6.7%. In doing so, varying concentrations of nanotubes could be extruded for testing. The master batch and a letdown thereof to the plaque size required for EMI shielding testing were extruded along with a neat PET control.

A ¾ inch Brabender single screw extruder with an engineering (higher compression) screw, run at 110 to 115 rpm screw speed was utilized. A die with a 6 inch width by 0.115" thick slit (with no adjustments for thickness control across extrudate width) was used to form the initial plaques. A shrouded rubber coated belt (with high air ventilation for cooling) for take-up, cooling and draw control was used to elongate the extruder plaques. Belt speed was controlled to induce various shearing loads via elongation. The coated belt effectively cooled the hot extrudate, grabbed onto it and restrained its shrinkage during its travel.

The base PET was readily and easily extruded, with no evidence of moisture-related bubbling. From literature, oriented PET dimensionally stabilizes below 70 C., and is drawable (orientable) between about 100 and 150 C. Draw of extrudate occurred in the short distance between the die and the contact point of extrudate with belt. This distance was generally an inch or two. Elongation was controlled in this area by the difference in the speed of the belt versus the speed of extrusion. Die and extrudate temperatures were in the range of 440–450 F. for natural PET. Natural PET extrudate a foot from the die (in contact with the belt) was 135–140 F.

By varying the shear rate and concentration of the nanotubes, and by utilizing the neat PET as a control, the EM shielding efficacy of the nanotubes as a function of concentration was determined, as well as the significance of shear on the nanotubes. It was determined that shear is important because, as produced in this test, the nanotubes are agglomerates and exist as curved, intertwined entanglements, somewhat like steel wool pads. By imparting shear in the process, the entanglements are pulled apart, thus increasing the effective aspect ratio of the nanotubes.

Electromagnetic Shielding Effectiveness (EMSE) tests between 20 kHz and 1.5 GHz on the PET-1.5 wt. % nanotube plaques and the neat PET were conducted. Testing was performed in accordance with conventional specs: MIL-STD-188-125A, ASTM D4935, IEEE-STD-299-1991, MIL-STD-461 C and MIL-STD-462.

The data, normalized for thickness, is shown in Table 1. Testing was performed at 22° C., a relative humidity of 39%, and atmospheric pressure of 101.7 kPa.

TABLE 1

Shielding Effectiveness of PET with 1.5 weight percent Nanotubes v. Elongation

| Sample Loading | | Shielding Effectiveness Test, dB, at Frequency | | | | | | | | | |
|---|---|---|---|---|---|---|---|---|---|---|---|
| | | 20 kHz | | 0.4 MHZ | | 15 MHZ | | 0.2 GHz | | 1.5 GHz | |
| and Elongation | Thickness | $SE_{pw}$ | $SE_m$ | $SE_{pw}$ | $SE_m$ | $SE_{pw}$ | $SE_m$ | $SE_{pw}$ | $SE_m$ | $SE_{pw}$ | $SE_m$ |
| Minimum target value | | 100 | | 100 | | 100 | | 100 | | 100 | |
| 1.5 wt % 10 to 1 | 1 mm | 182 | 116 | 180 | 114 | 182 | 116 | 184 | — | 184 | — |
| 1.5 wt % 6 to 1 | 1 mm | 114 | 48 | 113 | 52 | 116 | 56 | 119 | — | 120 | — |
| 1.5 wt % slight | 1 mm | 46 | 28 | 46 | 29 | 46 | 29 | 47 | — | 47 | — |
| Neat PET | 1 mm | 31 | 17 | 32 | 18 | 32 | 17 | 33 | — | 34 | — |

$SE_{pw}$ - plane wave shielding effectiveness; $SE_m$ - magnetic wave shielding effectiveness Each magnitude of the plane wave ($SE_{pw}$) and magnetic wave ($SE_m$) Shielding Effectiveness (SE) in Table 1 is an average from six (6) runs of the test at a given frequency. The experimental error evaluated by the partial derivatives and least squares methods does not exceed 6%. The linear arrangement of the generator and receiver antennas and the samples under test meet the requirements of MIL-STD-188-125. The following equipment was used during testing:

Generators: Model 650A HP (0.5 kHz to 110 MHZ) and Model 8673 HP (50 MHZ to 18 GHz)

Analyzers: Model 85928 HP and 8593L (both 9 kHz to 22 GHz)

Oscilloscope: ID-4540 HK, Nanoammeter 3503 RU with Metrologic Laser ML869S/C M 11

Antennas: HP 11968C, HP 11966C, HP 11966D; Dipole Antenna Set HP 11966H

Magnetic Field Pickup Coil HP 11966K, Active Loop H-Field HP 11966A

Dual Preamplifier HP8447F

Coniometer 3501-08 F-DM, Micrometer Hommelwerke (100000 nm), Starrett Dial Indicator 25-109

Digital Thermometer/Hygrometer Model 63-844 MI

This equipment meets the applicable National Institute of Standard and Technology (NIST), American Society for Testing Materials (ASTM), Occupation Safety and Health Administration (OSHA) and State requirements and was calibrated with the standards traceable to the NIST. The calibration was performed per ISO 9001 §4.11, ISO 9002 §4.10, ISO 9003 §4.6, ISO 9004 §13, MIL-STD-45662, MIL-I-34208, IEEE-STD-498, NAVAIR-17-35/MLT-1 and CSP-1/03-93. This equipment also passed a periodic accuracy test.

As can be seen, shearing is preferred in accordance with this invention.

Example 2

Dielectric Testing for Low Observability Correlation

In addition to the EMSE testing, dielectric testing to ASTM D2520 "Standard Text Test Methods for Complex Permittivity (Dielectric Constant) of Solid Electrical Insulating Materials at Microwave Frequencies and Temperatures to 1650 ° C." was performed. This method uses a waveguide cavity to measure the material at microwave frequencies. The cavity measurement is the most accurate dielectric measurement available at microwave frequencies. Although cavities are designed for a discrete frequency, within the normal microwave range material dielectric properties do not change over frequency, and thus this measurement is fairly accurate for the range. This trend can be noted in the EMSE testing, where shielding effectiveness did not appreciable change over frequency sweep of 20 kHz to 1.5 GHz.

The cavity volume used was 0.960 cubic inches and the cavity (Q) equals 4308, based on ambient temperatures and typical test equipment setup. Pertinent test data are as follows:

Sample: PET-1.5wt. % NTN

Shape of Test Sample: Cylinder

Volume of Test Sample (Vs): 0.00282 cubic inches

Empty Cavity Resonant Frequency (Fe): 9.263 GHz

Cavity Resonant Frequency, With Test Sample (FS): 9.028 GHz

The Q of the empty cavity is 4308

The Q of the cavity with the specimen: 25

Calculated relative dielectric constant, (k): 5.429

Calculate loss tangent, (tan delta): .6288

Calculated reflection at 1.5 GHz.: 16%

Table 1 shows the shielding effectiveness of 1.5 weight percent multi-walled carbon nanotubes mixed in a base host resin of polyethylene terephthalate (PET) at various frequencies and degrees of orientation. The data is normalized for a thickness of 1 mm and shows a broad band average plane wave shielding effectiveness ($SE_{pw}$) of 182 dB for high orientation shielding composite of the present invention at a loading level of only 1.5 wt %. The required broad band shielding effectiveness per MIL-STD-188-125A is 100 dB. The dielectric constant of this material is 5.429. From this dielectric constant, about 16% of the power will be reflected from a plane wave hitting the surface of the material. Correlating this data with that in Table 1 reveals that the primary shielding effectiveness mode of this present invention is absorption. The shielding composite of the present invention clearly offers both electromagnetic shielding and low observability.

Aspects of this invention include:

An electromagnetic (EM) shielding composite comprising a polymer and an amount effective for EM shielding of nanotubes, wherein said nanotubes are not bonded or glued together.

An electromagnetic (EM) shielding composite comprising a polymer and an amount effective for EM shielding of nanotubes, wherein said composite is subjected to shearing to optimize its EM shielding property.

An electromagnetic (EM) shielding composite comprising a polymer and an amount effective for EM shielding of nanotubes which are substantially not in contact with each other, other than along their longitudinal areas.

An electromagnetic (EM) shielding composite, according to the above, wherein said nanotubes, which are in contact with each other, if any, are not bonded or glued to each other.

An electromagnetic (EM) shielding composite, according to the above, wherein said polymer is not carbonizable.

An electromagnetic (EM) shielding composite, according to the above, wherein said polymer is not carbonizable.

An electromagnetic (EM) shielding composite, according to the above, wherein said composite has been subjected to shearing which disentangles and/or aligns said nanotubes.

An electromagnetic (EM) shielding composite comprising a polymer and an amount effective for EM shielding of nanotubes, said nanotubes having an effective aspect ratio of at least 100:1.

In an electromagnetic (EM) shielded enclosure comprising an inner space and a surface defining said space, the improvement wherein said surface comprises a layer of aligned nanotubes effective for EM shielding.

The electromagnetic shielding composite according to the above, wherein said polymer is derived from a natural source, including cellulose, gelatin, chitin, polypeptides, polysaccharides, or other polymeric materials of plant, animal, or microbial origin.

The electromagnetic shielding composite according to the above, wherein said nanotubes are substantially disentangled.

An electromagnetic attenuating composite which comprises: a loading of nanotubes substantially aligned in a polymer, wherein the alignment of said nanotubes is created in a shearing process.

The electromagnetic attenuating composite according to the above, wherein said loading is about 1.5% or less.

An electromagnetic attenuating composite which comprises: a loading of nanotubes substantially disentangled and mixed in a polymer, wherein the disentanglement is imparted by a shearing process.

The electromagnetic attenuating composite according to the above, wherein said loading is about 1.5% or less.

A method for preparing an electromagnetic (EM) shielding composite comprising a polymer and an amount effective for EM shielding of nanotubes, said method comprising formulating said polymer and said nanotubes and shearing said composite.

A method for lowering radar observability of an object comprising partially or entirely surrounding said object with a layer of aligned nanotubes effective for EM shielding.

A method for electromagnetic shielding an object or space comprising partially or entirely surrounding said object or space with a layer of aligned nanotubes effective for absorbing electromagnetic energy.

A method for producing an electromagnetic shielding composite comprising: providing a source containing nanotubes; providing a source containing a polymer; combining said source of nanotubes and said source of polymer; and, extruding said combination of nanotubes and polymer to impart a shearing force to the composite effective to enhance its shielding properties.

The method for producing an electromagnetic shielding composite according to the above, wherein the loading level of nanotubes is from 0.001 to 15 wt. % in the resulting composite.

The method for producing an electromagnetic shielding composite according to the above, wherein said extruding comprises imparting shear on said nanotubes so as to cause substantial alignment of said nanotubes.

The method for producing an electromagnetic shielding composite according to the above, wherein said extending comprises elongating said combination of nanotubes and polymer so as to control the degree of alignment of said nanotubes.

The method for producing an electromagnetic shielding composite according to the above, wherein said extruding comprises substantial disentangling of said nanotubes.

The method for producing an electromagnetic shielding composite according to the above, wherein said disentangling results in an increase of the EM shielding effectiveness.

A method for electromagnetic shielding, comprising: using a composite of nanotubes in a polymer to absorb electromagnetic radiation and thereby shield an object.

The method for electromagnetic shielding according to the above, wherein said composite effectively absorbs electromagnetic radiation in a range of $10^3$ Hz. to $10^{17}$ Hz.

The preceding examples can be repeated with similar success by substituting the generically or specifically described reactants and/or operating conditions of this invention for those used in the preceding examples.

While the invention has been particularly shown and described with reference to preferred embodiments thereof, it will be understood by those skilled in the art that various changes in form and details may be made therein without departing from the spirit and scope of the invention.

What is claimed is:

1. A composite for providing electromagnetic (EM) shielding, consisting essentially of:

a polymeric material; and an effective amount of oriented nanotubes for EM shielding, the nanotubes being oriented when a shearing force is applied to the composite.

2. The composite of claim 1, wherein the amount of nanotubes is from about 0.001 to about 15 weight percent of the composite.

3. The composite of claim 1, wherein the amount of nanotubes is from about 0.01 to about 5 weight percent of the composite.

4. The composite of claim 1, wherein the amount of nanotubes is from about 0.1 to about 1.5 weight percent of the composite.

5. The composite of claim 1, wherein the shearing force is applied by elongation.

6. The composite of claim 1, wherein the shearing force is applied by extrusion.

7. The composite of claim 1, wherein the shearing force is applied by injection.

8. The composite of claim 1, wherein the polymeric material is a thermoplastic polymer.

9. The composite of claim 1, wherein the polymeric material is a thermoset polymer.

10. The composition of claim 1, wherein the polymeric material is selected from the group consisting of polyethylene, polypropylene, polyvinyl chloride, styrenic, polyurethane, polyimide, polycarbonate, and polyethylene terephthalate.

11. The composition of claim 1, wherein the composite has a thickness of less than 1 mm.

12. The composite of claim 1, wherein the composite comprises an outer surface of an object.

13. The composite of claim 1, wherein the nanotubes are distributed homogeneously within said polymer.

14. The composite of claim 1, wherein the nanotubes have a length-to-diameter aspect ratio of at least 100:1.

15. A method for making a electromagnetic (EM) shielding comprising:

providing a polymer with an amount of nanotubes;

imparting a shearing force to the polymer and nanotubes to orient the nanotubes.

16. The method of claim 15, wherein the step of imparting a shearing force to the polymer and nanotubes to orient the nanotubes comprises:

applying an elongation force to the composite.

17. The method of claim 15, wherein the step of imparting a shearing force to the polymer and nanotubes to orient the nanotubes comprises:

applying an extrusion force to the composite.

18. The method of claim 15, wherein the step providing a polymer with an amount of nanotubes comprises:

providing a composite having from about 0.001 to about 15 weight percent of nanotubes.

19. The method of claim 15, wherein the step providing a polymer with an amount of nanotubes comprises:

providing a composite having from about 0.01 to about 5 weight percent of nanotubes.

20. The method of claim 15, wherein the step providing a polymer with an amount of nanotubes comprises:

providing a composite having from about 0.1 to about 1.5 weight percent of nanotubes.

21. The method of claim 15, wherein the polymeric material is a thermoplastic polymer.

22. The method of claim 15, wherein the polymeric material is a thermoset polymer.

23. The method of claim 15, wherein the polymeric material is selected from the group consisting of polyethylene, polypropylene, polyvinyl chloride, styrenic, polyurethane, polyimide, polycarbonate, and polyethylene terephthalate.

24. The method of claim 15, wherein the step of imparting a shearing force to the polymer and nanotubes to orient the nanotubes comprises:

applying an elongation force to the composite.

25. The method of claim 15, wherein the step of imparting a shearing force to the polymer and nanotubes to orient the nanotubes comprises:

applying an extrusion force to the composite.

26. The method of claim 15, wherein the step of imparting a shearing force to the polymer and nanotubes to orient the nanotubes comprises:

applying an injection force to the composite.

27. The method of claim 15, further comprising the step of:

applying the composite to an outer surface of a component.

* * * * *